United States Patent [19]

Oonishi et al.

[11] Patent Number: 4,466,413

[45] Date of Patent: Aug. 21, 1984

[54] FUEL CUT SYSTEM FOR ELECTRONIC CONTROL SYSTEM

[75] Inventors: Akito Oonishi, Toyota; Haruo Watanabe, Okazaki, both of Japan

[73] Assignee: Toyota Jidosha Kogyo Kabushiki Kaisha, Aichi, Japan

[21] Appl. No.: 391,715

[22] Filed: Jun. 24, 1982

[51] Int. Cl.[3] ..... F02B 3/00

[52] U.S. Cl. ..... 123/493

[58] Field of Search ..... 123/326, 493, 492

[56] References Cited

U.S. PATENT DOCUMENTS

| | | | |
|---|---|---|---|
| 4,245,605 | 1/1981 | Rice | 123/493 |
| 4,266,522 | 5/1981 | Williams | 123/493 |
| 4,311,123 | 1/1982 | Glockler | 123/493 |
| 4,327,682 | 5/1982 | Harada | 123/493 |
| 4,353,342 | 10/1982 | Sugasawa | 123/493 |
| 4,357,924 | 11/1982 | Sugasawa | 123/493 |
| 4,391,243 | 7/1983 | Bessho | 123/493 |
| 4,392,467 | 7/1983 | Mivagi | 123/493 |

*Primary Examiner*—Ronald B. Cox

*Attorney, Agent, or Firm*—Parkhurst & Oliff

[57] ABSTRACT

The present invention relates to a fuel cut system for an electronic control system of an engine. When the deceleration of engine rotation is large during fuel cut, the fuel cut is interrupted at the rotational speed higher than when the deceleration is small, and thereby the engine stop caused by the fuel cut during racing period or the like is prevented.

4 Claims, 4 Drawing Figures

FUEL CUT SYSTEM FOR ELECTRONIC CONTROL SYSTEM

BACKGROUND OF THE INVENTION

1. Field of the Invention:

This invention relates to a fuel cut system for an electronic control engine.

2. Description of the Prior Art:

When the deceleration of engine rotation is large and the rotational speed of the engine in which the fuel cut is completed is low, the rotational speed of the engine is rapidly reduced even after the resumption of fuel supply, resulting in the engine stop. Corrective measures contemplated to avoid such a situation are enumerated as follows;

(1) When the fuel cut is carried out with 7 km/h or less vehicle speed as in the case of racing, the rotational speed of the engine in which the fuel cut is completed is set to a large value.

(2) When a clutch is released as in the case of a transmission under the neutral condition, the fuel cut is stopped.

(3) When the deceleration of engine rotation is larger asynchronous fuel injection is carried out in the resumption of fuel supply.

In the first and second corrective measures, fuel cut time is reduced and rate of fuel consumption cannot be sufficiently improved. In the second corrective measure, a detector and wiring for detecting the released condition of clutch are needed so that the constitution is complicated. In the third corrective measure, the rotational speed of the engine is temporarily lower than idling rotational speed even after the resumption of fuel supply so that third corrective measure cannot sufficiently avoid the engine stop.

SUMMARY OF THE INVENTION

An object of the present invention is to provide a fuel cut system for an electronic control engine in which the engine stop after the resumption of fuel supply is avoided even when deceleration of the engine rotation is large and thus a period of carrying out the fuel cut is to be sufficiently elongated.

According to the present invention to achieve this object, when the deceleration of the engine rotation during the fuel cut is less than a predetermined value and the rotational speed of the engine is lowered to a first predetermined value, the fuel cut is completed. When the deceleration of the engine rotation during the fuel cut is larger than the predetermined value and the rotational speed of the engine is lowered to a second predetermined value larger than the first one, the fuel cut is completed and asynchronous fuel injection is carried out immediately after the completion of the fuel cut.

When the deceleration of the engine rotation is large, the fuel cut is stopped in the rotational speed of the engine larger than that in the usual case to resume the fuel supply. The engine stop is avoided in this case, since asynchronous fuel injection is carried out after the completion of fuel cut to generate explosion from the first combustion process after the completion of fuel cut. In an electronic control engine carrying out 2 times of synchronous fuel injection for 1 cycle of the engine, i.e. 2 rotations of the crankshaft, injection amount by 1 time of the synchronous fuel injection is a half of the requested injection amount for each cylinder. Thus, explosion is not generated in the first synchronous fuel injection after the completion of fuel cut and the output generation of the engine is delayed by the first revolution of the engine. This has an important effect on the recovery of the engine output in the rotational speed of the engine at the resumption of fuel supply. According to the present invention, the engine output can be generated since the first revolution after the completion of fuel cut by includes the asynchronous fuel injection.

The deceleration of the engine rotation in the case of a racing or neutral condition is larger than that in the case of normal travelling with speed reduction. Since the racing or neutral condition is to be detected from the deceleration according to the present invention, a detector and wiring for detecting the released condition of the clutch can be obviated to simplify the constitution of the system. Also, in the case of the racing or neutral condition, the engine stop is avoided to carry out the fuel cut. Further, since the rotational speed of the engine after the completion of fuel injection is to a be set to sufficiently low value with the normal speed reduction, the rate of consumption is to be substantially improved.

In a preferred embodiment of the present invention, when the rotational speed of the engine reaches the second predetermined value, the deceleration of the engine rotation is judged relative to the predetermined value. When the deceleration of the engine rotation is larger than the predetermined value, the asynchronous fuel injection is carried out and synchronous fuel injection is started. When the deceleration of the engine rotation is less than the predetermined value, the rotational speed of the engine is larger than the first predetermined value to determine the stoppage of the fuel cut.

BRIEF DESCRIPTION OF THE DRAWINGS

A preferred embodiment of the present invention is described below in detail with reference to the attached drawings wherein.

DETAILED DESCRIPTION OF PREFERRED EMBODIMENTS

Figure 1:
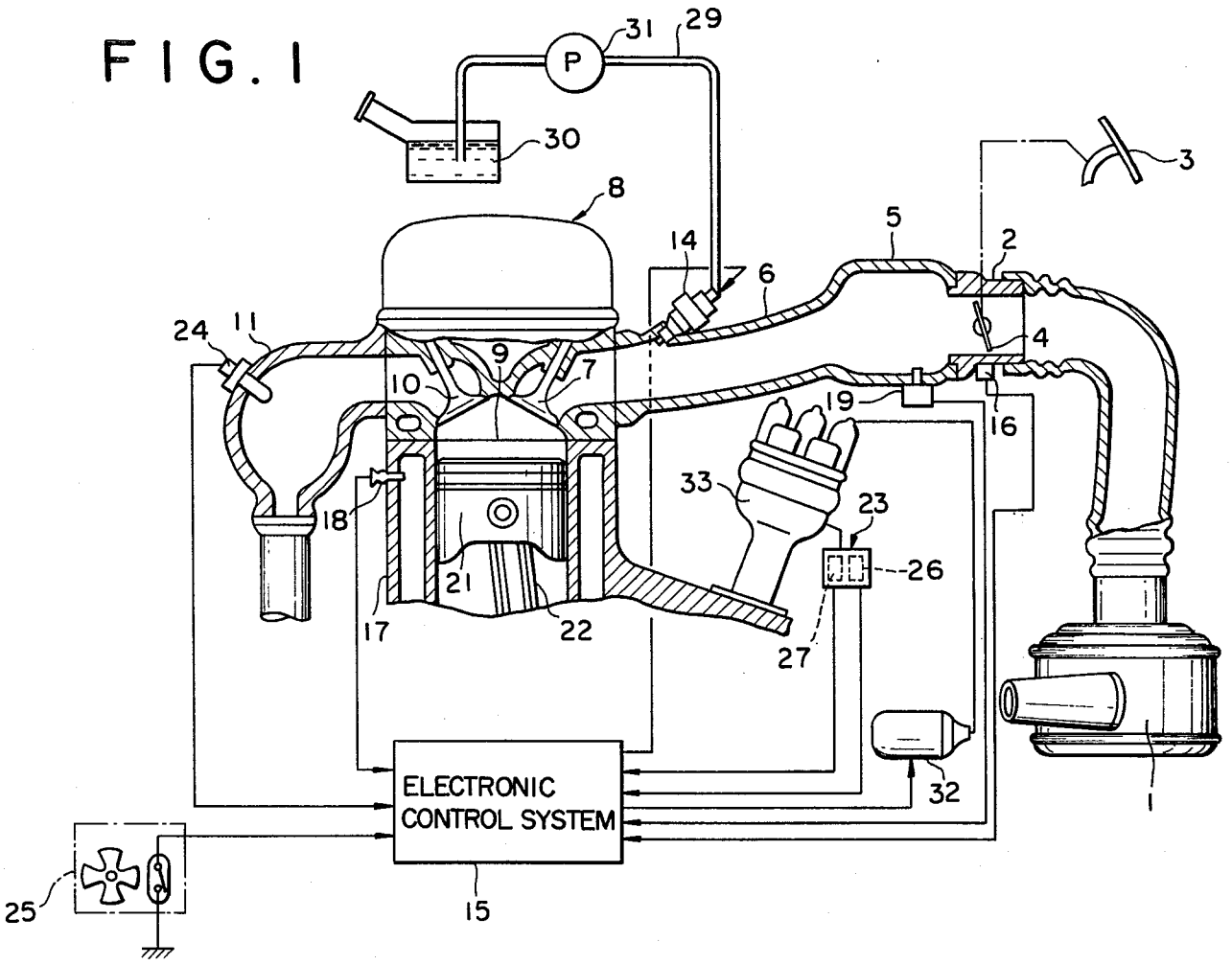
FIG. 1 is a schematic drawing showing the whole electronic control engine according to the present invention.

FIG. 1 shows generally the whole electronic control fuel injection engine according to the present invention. Air flow sucked from an air cleaner 1 is controlled by a throttle valve 4 provided in a throttle body 2 and interlocked with an accelerator pedal 3 in a cab. The air is then supplied to a combustion chamber 9 in a engine body 8 through a surge tank 5, intake pipe 6 and intake valve 7. Mixture burnt in the combustion chamber 9 is purged as exhaust gas through an exhaust valve 10 and exhaust manifold 11. An electromagnetic fuel injection valve 14 is provided in the intake pipe 6 corresponding to each combustion chamber 9. An electronic control unit 15 receives the input signals from various sensors which include: a throttle switch 16 for detecting the full closing of the throttle valve 2; water temperature sensor 18 mounted on a water jacket 17 in the engine body 8; negative pressure sensor 19 provided in the surge tank 5 for detecting intake pipe vaccum related to the intake air flow rate; crank angle sensor 23 for detecting rotary angle of a distributor shaft that is coupled with a crankshaft to detect rotary angle of the crankshaft which is coupled to a piston 21 through a connecting rod 22; air-fuel ratio sensor 24 provided in the exhaust manifold 11 for detecting oxygen concentration in exhaust gas, and a vehicle speed sensor 25. Other types of sensors may also supply signals to the control unit 15. The rotary angle sensor 23 is provided with one first portion 26 for generating one pulse per 2 rotations of the crankshaft and another second portion 27 for generating the pulse per a predetermined crank angle, for example, 30°. Fuel is forcibly sent to the fuel injection valve 14 from a fuel tank 30 through a fuel path 29 by a fuel pump 31.

The electronic control unit 15 computes fuel injection amount and period on the basis of various input signals to send fuel injection pulses to the fuel injection valve 14 while computing the ignition timing to send signals to an ignition coil 32. Secondary current in the ignition coil 32 is sent to a distributor 33. Further, the injection valve 14 is maintained under the opened condition only when it receives pulses from the electronic control unit 15.

Figure 2:
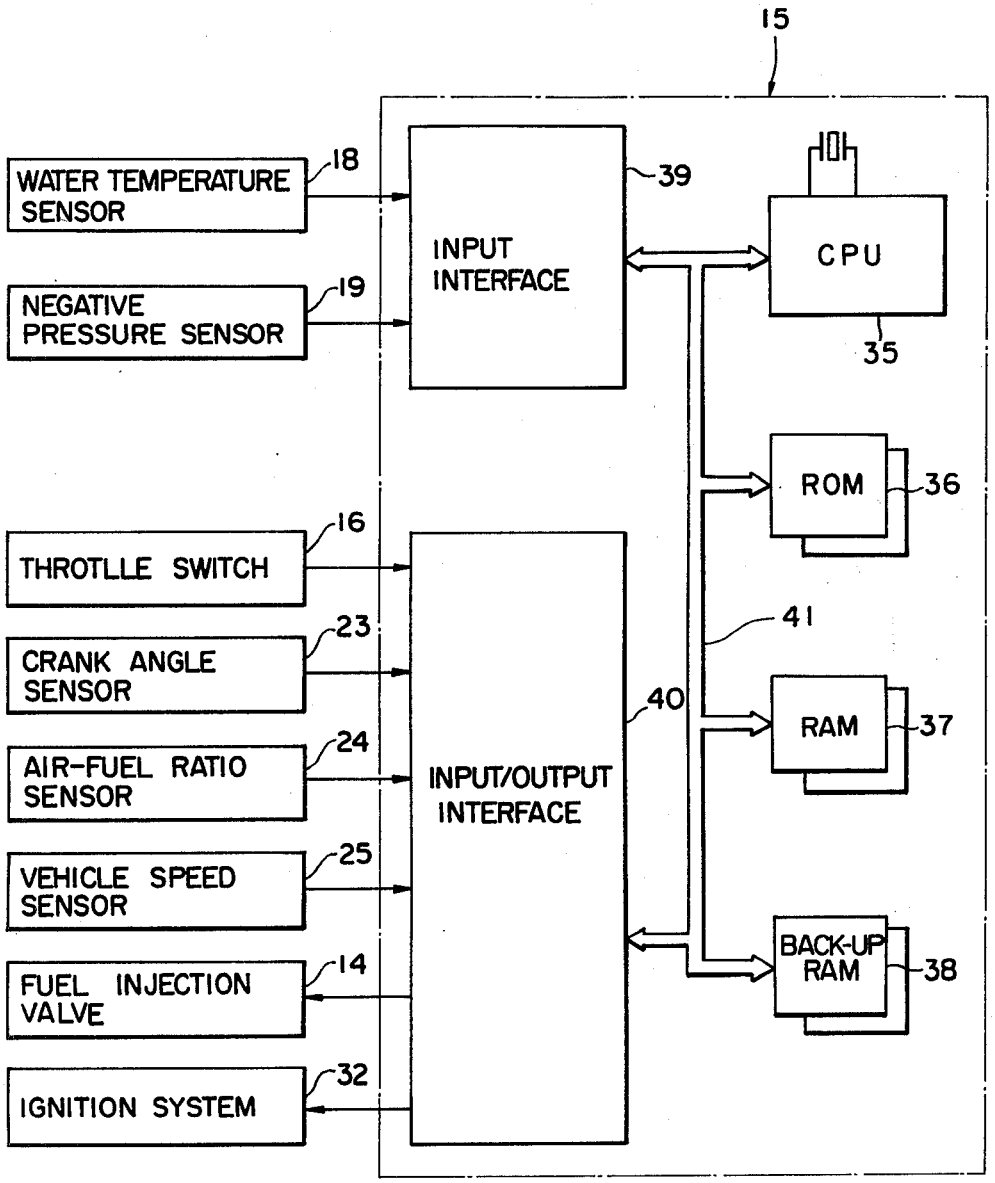
FIG. 2 is a block diagram of the electronic control unit shown in FIG. 1.

FIG. 2 shows a block diagram of the interior of the electronic control unit 15. The control unit 15 includes a CPU (Central Processing Unit) 35 as a digital processor, a ROM (Read-Only Memory) 36, a RAM (Random Access Memory) 37, back-up a RAM 38, input an interface 39 and an input/output interface 40 which are connected with each other through a bus 41. The back-up RAM 38 is to be supplied with a predetermined power to store memory even when the engine is stopped. The input interface 39 has a built-in A/D (Analog/Digital) converter, and the analog outputs of the water temperature sensor 18 and negative pressure sensor 19 are sent to the input interface 39. The outputs of the throttle switch 16, crank angle sensor 23, air-fuel ratio sensor 24 and vehicle speed sensor 25 are sent to the input/output interface 40, and the electric signals to the fuel injection valve 14 and ignition coil 32 are sent from the input/output interface 40.

Figure 3:
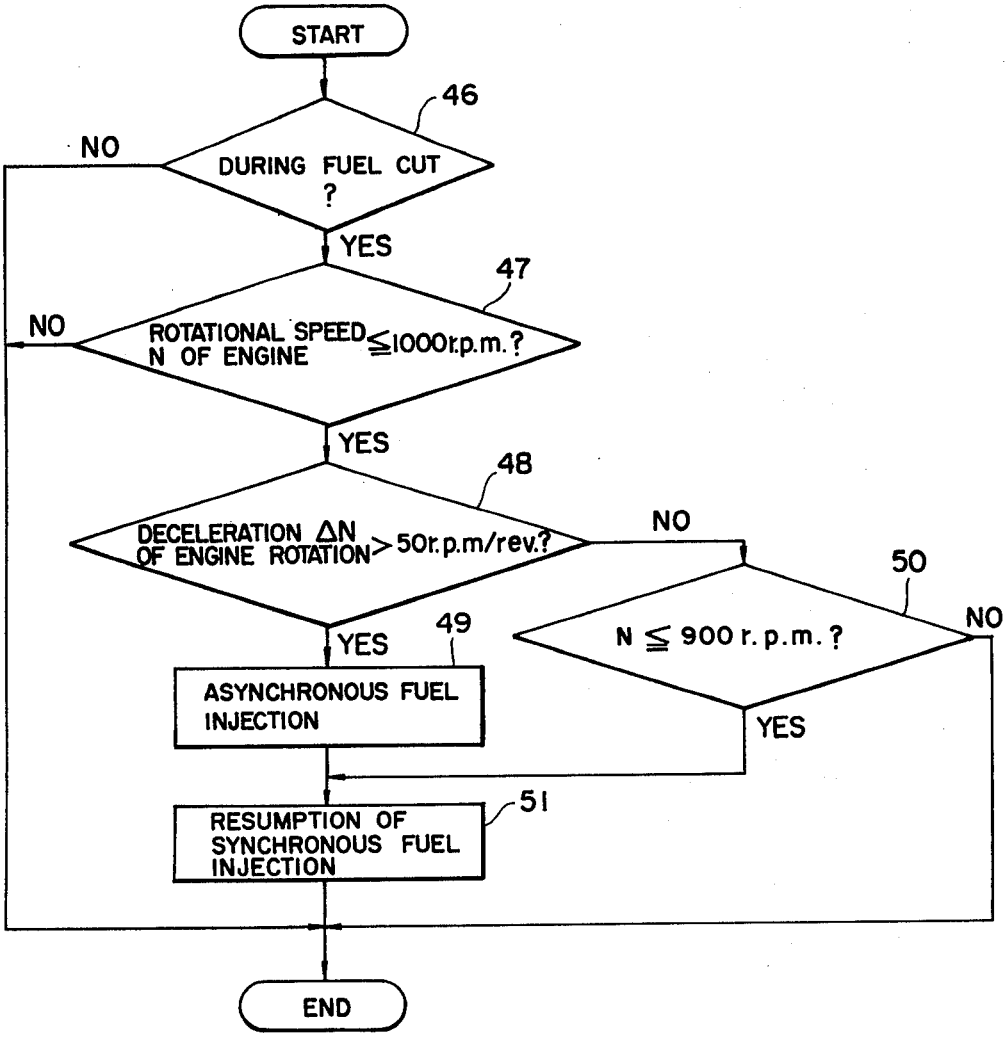
FIG. 3 is a flow chart of a program for carrying out the present invention.

FIG. 3 is a flow chart of a program for carrying out the present invention. In step 46, it is judged whether or not fuel is cut, and if it is judged yes, the program proceeds to step 47. If not, the program is completed so that the fuel supply is continued. In step 47, it is judged whether or not the rotational speed N of the engine is less than a second predetermined value, for example, 1,000 r.p.m. If it is judged yes, the program proceeds to step 48 and if not, the program is completed so that the fuel cut is continued. In step 48, it is judged whether or not the deceleration $\Delta N$ of the engine rotation (thus, the acceleration is $-\Delta N$) is larger than a predetermined valve, for example, 50 r.p.m. per 1 engine rotation. If it is judged yes the program proceeds to step 49 and if not to step 50. If N is larger than 50 r.p.m., then the asynchronous fuel injection is carried out (step 49), i.e. fuel injection in which injection timing is independent of the rotation of the crank angle, through the fuel injection valve 14. Fuel injection time according to the asynchronous fuel injection is for example 4.5 m.sec. This corresponds to a half or more of requested fuel injection amount per 1 cycle of each cylinder. In step 50, it is judged whether or not the rotational speed N of the engine is less than a first predetermined value, for example, 900 r.p.m. If it is judged yes, the program proceeds to step 51 and if not the program is completed so that the fuel cut is continued. In step 51, the synchronous fuel injection, i.e. injection in which the fuel injection time is controlled to correspond to a predetermined crank angle of 1 cycle of the engine, is resumed. When step 49 is carried out, total fuel amount of the asynchronous fuel injection plus the first synchronous fuel injection after the completion of the fuel interruption exceeds one an amount necessary for explosion. Accordingly, the explosion is produced from the first single engine rotation after the completion of the fuel cut and thereafter the rotational speed of the engine is gradually reduced.

Figure 4:
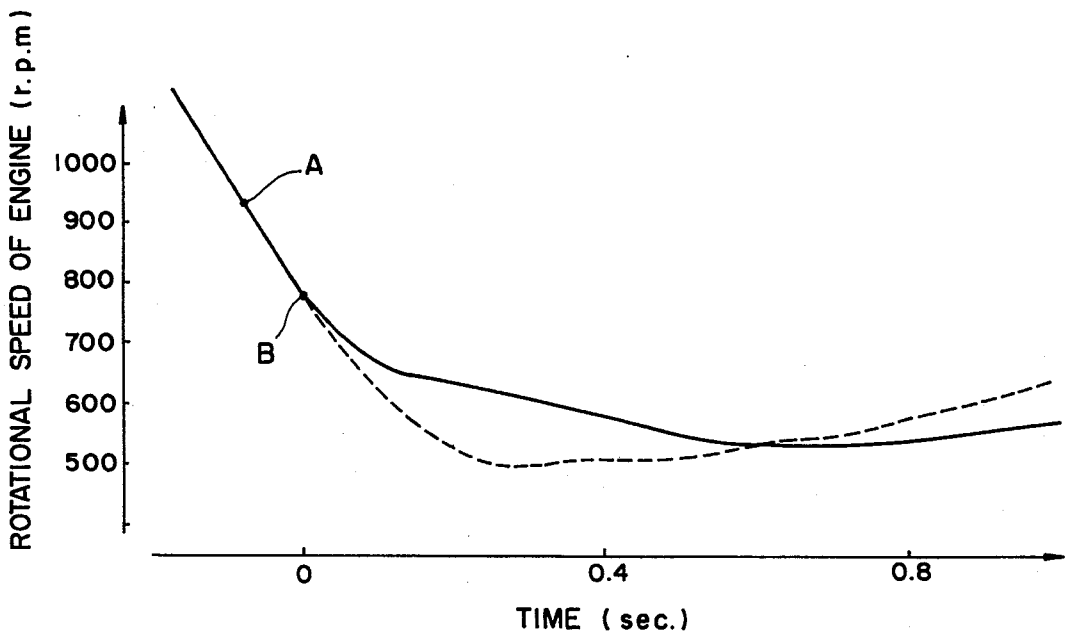
FIG. 4 is a graph which compares the hourly changes in the rotational speed of the engine in the cases of racing of the present invention and prior device.

FIG. 4 shows changes in the rotational speed time of the engine while racing with the maximum electric load (lamps, heater, etc.) for vehicle. The solid line shows the change in the case of the present invention and the broken line shows the change in the case of a prior device which uniformly completes the fuel cut at 900 r.p.m. and carries out the asynchronous fuel injection to resume the fuel supply. According to the present invention, the first explosion after the completion of the fuel cut happens at point A in which the rotational speed of the engine exceeds 900 r.p.m., whereas the first explosion in the prior device happens at point B in which the rotational speed of the engine is reduced. Thus, according to the present invention the rotational speed of the engine is gradually reduced to the idling rotational speed.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A fuel cut system for an electronic control engine, comprising an electronic control unit for selectively supplying fuel to the engine, said control unit completing the fuel cut when deceleration of the engine rotation during the fuel cut is less than a predetermined value with the rotational speed of the engine being reduced to a first predetermined value, the fuel cut being completed and asynchronous fuel injection being carried out immediately after the fuel cut when the deceleration of the engine rotation during the fuel cut is greater than said predetermined value with the rotational speed of the engine being lowered to a second predetermined value larger than the first predetermined value.

2. A fuel cut system as defined in claim 1, wherein, the deceleration of the engine rotation is judged relative to said predetermined value when the rotational speed of the engine reaches the second predetermined value so that, when the deceleration of the engine rotation is larger than the predetermined value, the asynchronous fuel injection is carried out and synchronous fuel injection is started, and when the deceleration of the engine rotation is less than the predetermined value, the rotational speed of the engine is judged relative to the first predetermined value to determine the stoppage of the fuel cut.

3. A fuel cut system as defined in claims 1 or 2, wherein the asynchronous fuel injection is carried out once for one revolution of a crankshaft.

4. A fuel cut system as defined in claim 3, wherein fuel amount in said asynchronous fuel injection corresponds to more than a half of requested fuel amount.

* * * * *

UNITED STATES PATENT AND TRADEMARK OFFICE

CERTIFICATE OF CORRECTION

PATENT NO. : 4,466,413

DATED : August 21, 1984

INVENTOR(S) : Akito OONISHI, ET AL.

It is certified that error appears in the above-identified patent and that said Letters Patent is hereby corrected as shown below:

Item [30] Foreign Application Priority Data should read:

-- Item [30] - March 23, 1982 [JP] Japan .....44488/1982 --

Signed and Sealed this

*Twelfth* Day of *February 1985*

[SEAL]

*Attest:*

DONALD J. QUIGG

*Attesting Officer* *Acting Commissioner of Patents and Trademarks*